US007735302B2

(12) United States Patent
Monti

(10) Patent No.: US 7,735,302 B2
(45) Date of Patent: Jun. 15, 2010

(54) DEVICE FOR PICKING UP ARTICLES FROM A SUPPLY STATION AND FOR INSERTING THE ARTICLES INTO A CONTAINER

(75) Inventor: Giuseppe Monti, Pinaoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 141 days.

(21) Appl. No.: 12/041,300

(22) Filed: Mar. 3, 2008

(65) Prior Publication Data

US 2008/0222999 A1 Sep. 18, 2008

(30) Foreign Application Priority Data

Mar. 14, 2007 (IT) ..... BO2007A0179

(51) Int. Cl.
*B65B 57/10* (2006.01)
*B65B 35/38* (2006.01)

(52) U.S. Cl. ..... 53/499; 53/247

(58) Field of Classification Search ..... 53/498, 53/499, 501, 158, 539, 237, 238, 240, 244, 53/246, 247, 250; *B65B 5/12, 35/38*
See application file for complete search history.

(56) References Cited

U.S. PATENT DOCUMENTS 2,457,220 A * 12/1948 Fowler et al. ..... 53/244
2,957,290 A * 10/1960 Andreessen ..... 53/240
3,091,067 A * 5/1963 Ulicky et al. ..... 53/244
3,169,354 A * 2/1965 Bliss et al. ..... 53/499
3,604,184 A * 9/1971 Shuttleworth ..... 53/157
3,986,638 A * 10/1976 DeHart ..... 221/150 A
4,385,482 A * 5/1983 Booth ..... 53/240
4,674,259 A 6/1987 Hills
4,693,057 A * 9/1987 Rittinger et al. ..... 53/539
4,832,180 A * 5/1989 Ferrero ..... 198/468.3

(Continued)

FOREIGN PATENT DOCUMENTS

DE 16 11 840 B 10/1971

(Continued)

*Primary Examiner*—Stephen F Gerrity
(74) *Attorney, Agent, or Firm*—William J. Sapone; Coleman Sudol Sapone P.C.

(57) ABSTRACT

A device for picking up articles from a supply station and inserting the articles into a container, comprising: at least an operating head, provided with a group of depression-activated gripping units, each of which is shaped in a special format to pick up and retain a corresponding article; control devices, which verify a presence of an article at each of the gripping units; movement organs which cause the operating head to perform outward and return runs, respectively from a picking up station of the articles to a release station of the articles, situated nearby the container, and vice versa; a conveyor device, provided at the release station, above the opening of the container, and destined to be interposed between the opening and the operating head to guide insertion of the articles into the container; enabling organs, activated in a phase relation with the movement organs, for activating the gripping units at the supply station in order for a corresponding number of articles to be picked up by the use of the gripping units, and for deactivating the gripping units at the release station, thus disengaging the articles from the gripping units and causing the articles to fall into the conveyor device located there below.

14 Claims, 2 Drawing Sheets

U.S. PATENT DOCUMENTS

| | | | | | |
|---|---|---|---|---|---|
| 5,369,940 | A | * | 12/1994 | Soloman | 53/501 |
| 5,442,892 | A | * | 8/1995 | Burns, III et al. | 53/53 |
| 6,185,901 | B1 | | 2/2001 | Aylward | |
| 6,681,550 | B1 | | 1/2004 | Aylward | |
| 7,073,312 | B2 | * | 7/2006 | Battisti | 53/537 |
| 2002/0104291 | A1 | | 8/2002 | Kondou et al. | |

FOREIGN PATENT DOCUMENTS

| | | | | |
|---|---|---|---|---|
| DE | 102004006375 | | * | 9/2005 |
| EP | 0 224 017 | A | | 6/1987 |
| EP | 0 239 547 | A | | 9/1987 |
| JP | 2003081223 | A | * | 3/2003 |
| WO | WO 96/17776 | A | | 6/1996 |

* cited by examiner

DEVICE FOR PICKING UP ARTICLES FROM A SUPPLY STATION AND FOR INSERTING THE ARTICLES INTO A CONTAINER

BACKGROUND OF THE INVENTION

The invention concerns the technical sector of automatic machines for packing articles, such as pills, tablets and the like, into containers, such as vials or jars, or boxes or the like.

Known machines of this type are used in the pharmaceutical industry, while other less sophisticated machines are used mainly for foodstuffs or confectionery.

For uses in the pharmaceutical industry a predetermined number of articles, counted with absolute precision, must be inserted inside the container, while for other uses it can suffice to guarantee a minimum number or weight.

According to a relatively widespread construction design scheme for the abovementioned machines, known as counters, there is a first operating line where the containers are gripped and transferred to a filling station, into which a second line also flows, supplying the articles to the insertion organs which insert the articles into the containers, with all the foregoing taking place in observance of predetermined control protocols concerning the number and/or overall weight of the articles inserted into the container.

Clearly the greatest differences between one machine and another, apart from the solutions adopted for transporting the various types of container, concern the conformation of the insertion organs and the ways according to which the insertion organs operate.

Based on specific requirements, therefore, the insertion organs will be obtained with more or less ingenious and/or complex technical solutions; in the pharmaceutical sector, where counting must be absolutely precise, recourse must necessarily be made to solutions which, although complex and often expensive, are capable of fulfilling the required conditions.

To minimize errors during counting, the articles must be separated one by one, directed towards for example mechanical, electromechanical or optical counting means, and finally inserted into the containers; alternatively, after counting they can be batched before being inserted into the container.

In some types of machine separating organs are obtained with formatted elements, which have to be replaced whenever the article being handled changes; when shape, rather than the dimensions of the article vary, the functioning of the abovementioned organs may be impaired, or be totally incompatible with the article.

A further drawback, which can arise with the above-described mode of operation, concerns the damage that certain highly fragile articles may undergo during the manipulation to which they are subjected in the separation, counting and batching stages.

SUMMARY OF THE INVENTION

An aim of this invention is therefore to provide a device which picks up articles from a supply station and inserts the articles into a container, and is conformed in such a way that it does not require prior separation of the articles and that the batching of articles is achieved directly inside the container.

A further aim of the invention consists in providing a device consisting of a restricted number of organs and, among these organs, limiting as much as possible the use of organs exhibiting a specific format, such as to obtain a high degree of flexibility and limited manufacturing costs in consideration of the results obtained.

A still further aim of the invention is to provide a device with characteristics which ensure that it is suited to use in any sector and advantageously suited to use in the pharmaceuticals sector.

The above mentioned aims are obtained by means of a device for picking up articles from a supply station and inserting the articles into a container, wherein it comprises: at least an operating head, provided with a group of depression-activated gripping units, each of which is shaped in a special format to pick up and retain a corresponding article; control means, which verify a presence of an article at each of the gripping units; movement organs which cause the operating head to perform outward and return runs, respectively from a picking up station of the articles to a release station of the articles, situated nearby the container, and vice versa; conveyor means, provided at the release station, above the opening of the container, and destined to be interposed between the opening and the operating head to guide insertion of the articles into the container; enabling organs, activated in a phase relation with the movement organs, for activating the gripping units at the supply station in order for a corresponding number of articles to be picked up by means of the gripping units, and for deactivating the gripping units at the release station, thus disengaging the articles from the gripping units and causing the articles to fall into the conveyor means located there below.

BRIEF DESCRIPTION OF THE DRAWINGS

The characteristics of the invention will be made evident in the description below of a preferred embodiment of the device, in accordance with the claims and with the assistance of the appended figures of the drawings, wherein:

DESCRIPTION OF THE PREFERRED EMBODIMENTS

With reference to the figures, the number 100 denotes the device of the invention in its entirety.

The device 100 is preferably destined to be associated to a packing machine of known type as indicated in the preamble and not shown in detail, in which a transport line is provided which advances a container 1, constituted for example by a vial, a jar, or the like, to a filling station SR, with the opening 1A thereof facing upwards.

In the filling station SR, the device 100 inserts a predetermined number of articles 2, for example tablets, pills or the like, into the container 1.

Downstream of the filling station SR there are further known-type stations, not illustrated, in which the container 1, filled with articles 2, is closed for example by means of a cap.

For the sake of descriptive simplicity, a step-activated packing machine is described, in which each container 1 pauses at the filling station SR for the time necessary for the device 100 to perform the operating stages; however, as indicated below, the device 100 can also be utilized in a continuously activated packing machine.

Figure 1:
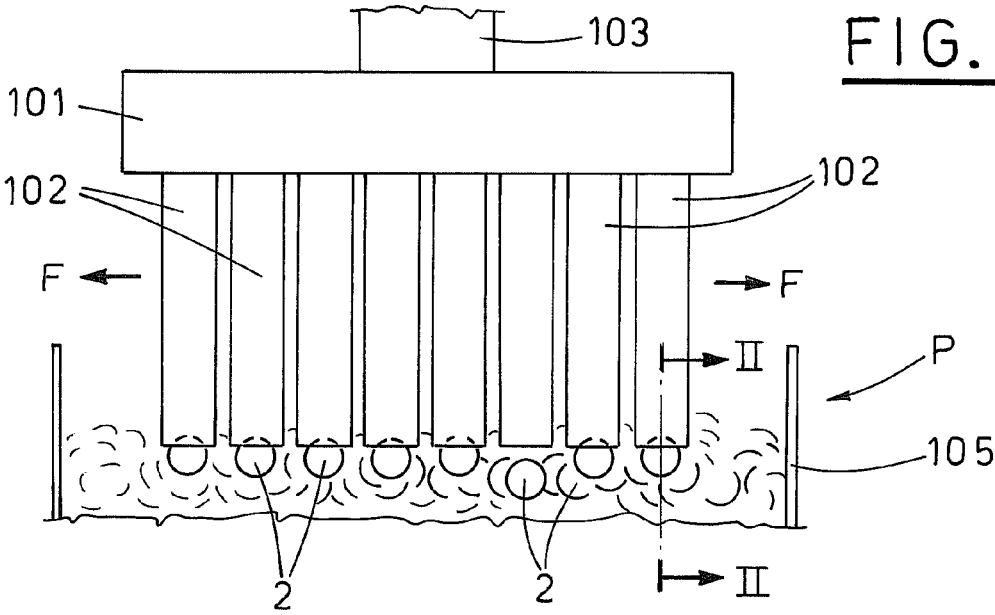
FIG. 1 is a schematic side view of an operating head of the device during an article picking up stage.
Figure 2:
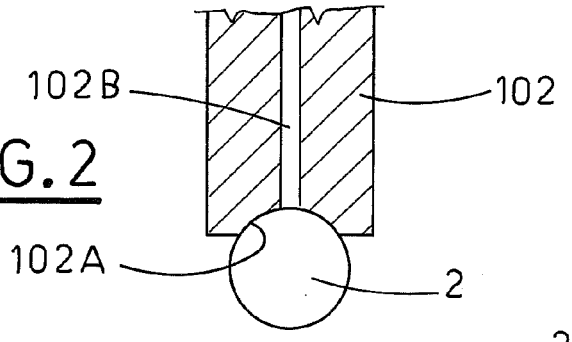
FIG. 2 is a partial, enlarged section view, along plane II-II of FIG. 1, of a gripping unit of the device.
Figure 4:
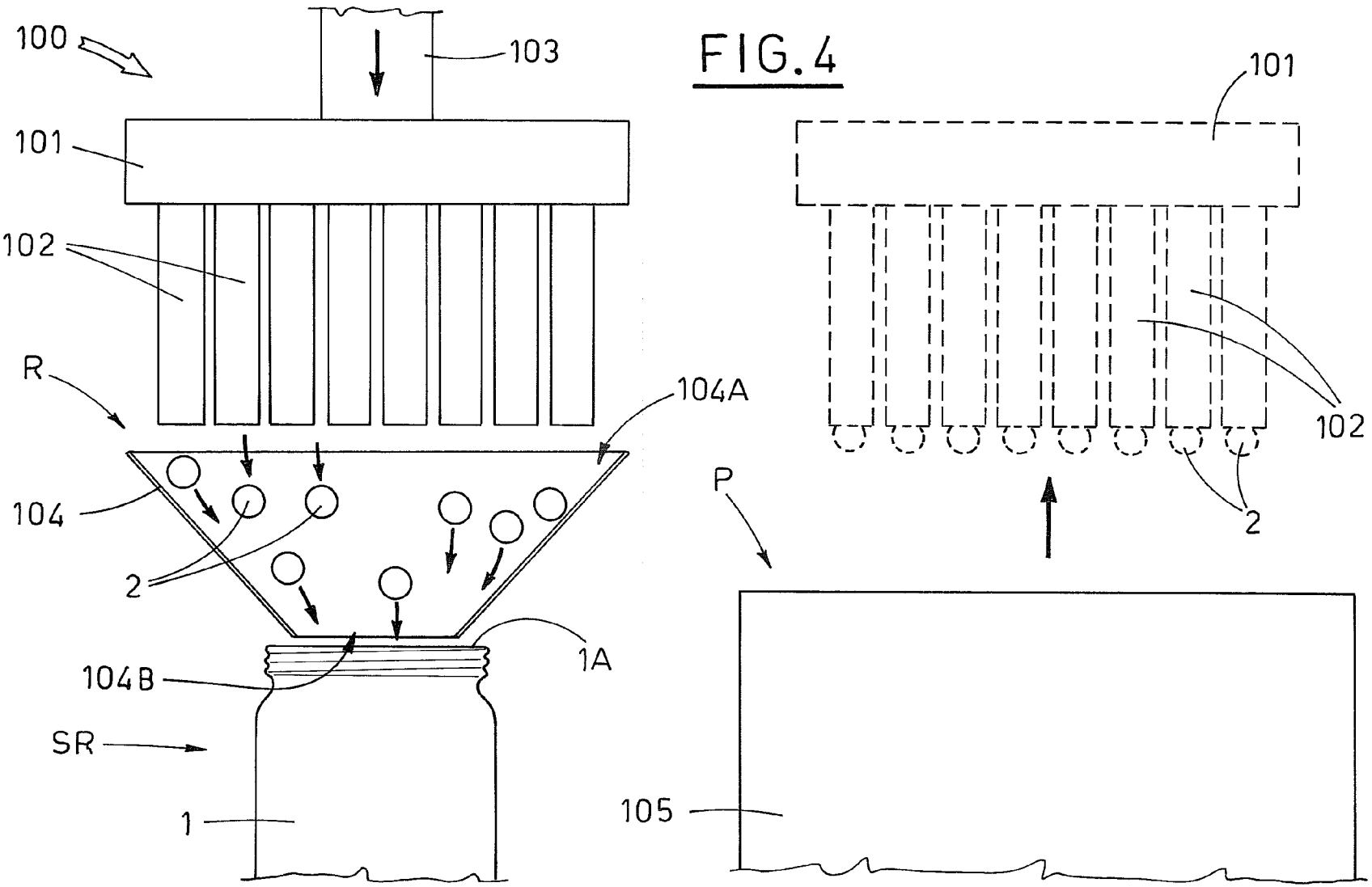
FIG. 4 shows, in the same view as FIG. 1, the operating head of the device in the phase when the articles are inserted into a container.

The device 100 comprises an operating head 101 provided with a group of depression-activated gripping units 102, extending downwards and each consisting of an elongate body the end of which affords a seating 102A, communicating with an aspirating conduit 102B realized axially in the body of the relative gripping unit 102 (FIGS. 1, 2, 4).

Figure 3:
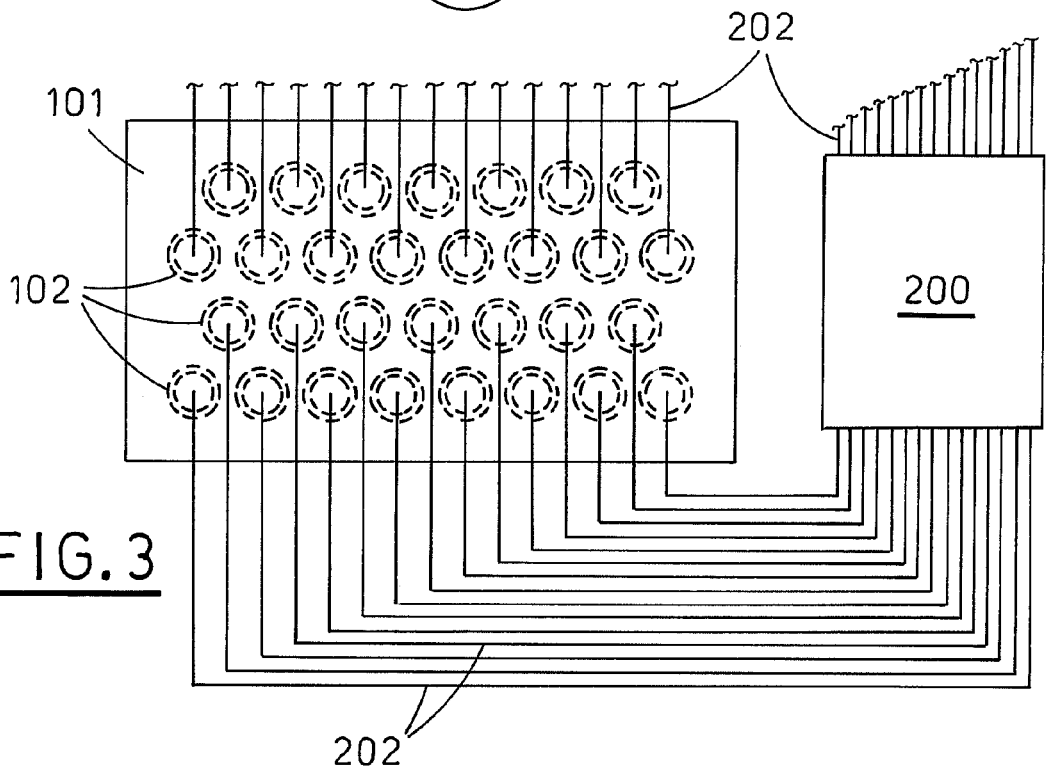
FIG. 3 is a schematic plan view of the device.

Each aspiration conduit 102B is connected, by a relative tube 202, to a depression source 200, external to the operating head 101 (FIG. 3) and is provided with respective intercepting organs, not shown, the opening and closing of which allow or prevent a connection with the depression source 200.

Each seating 102A is shaped in a specific format such as to receive and retain a corresponding article 2; the example in the figures refers to articles 2 of spherical shape, while the seatings 102A are cap-shaped with the same radius.

Naturally the seatings 102A can be differently shaped, according to the shape of the article 2, but in any case they must allow only one article 2 to be collected per gripping unit 102.

The device 100 comprises control means, not shown in detail, which verify the presence or absence of an article 2 in each seating 102A; these means, associated to each gripping unit 102, can be for example of the type which measures the depression existing in the aspiration conduit 102B.

The operating head 101 is borne by movement organs 103, which advance and retract the head, respectively from a picking up station P of the articles 2 (FIG. 1 and broken lines in FIG. 4) to a release station R of the articles 2, at the container 1 (continuous lines in FIG. 4), and vice versa.

The movement organs 103, of which only the end portion is schematically represented, are of substantially known type and for example consist of a robotic arm with Cartesian axes or an anthropomorphic robotic arm, provided with appropriate electronically controlled movements, in accordance with the type of advancement of the container 1.

The picking up station P is defined by a tray 105 (FIGS. 1 and 4) into which the articles 2 are fed loose and in which there are organs, not shown, which maintain a predetermined level of articles 2, as homogeneous as possible in the various areas of the tray 105.

In the release station R there are conveyor means 104, arranged over the opening 1A of the container 1 at rest at the release station R, destined to be interposed between the opening 1A of the container 1 and the operating head 101 in order to guide the insertion of the articles 2 into the container 1, as described below.

The conveyor means 104 are constituted for example by a hopper an upper inlet section of which 104A has a greater area than the area of the group of gripping units 102 seen in plan view, and which has a lower outlet section 1048 that is lower than that of the opening 1A of the container 1.

During the first operating stage of the device 100, the operating head 101 is positioned by the movement organs 103 at the picking up station P and lowered into the tray 105 such that the gripping units 102 operate in the heap of articles 2 (FIG. 1), the intercepting organs of the aspiration conduits 102B being open.

At this point the movement organs 103 make the operating head 101 effect one or more horizontal movements, of a predetermined amplitude and direction (arrows F in FIG. 1), to facilitate the spontaneous attachment, by aspiration, of a corresponding article 2 to a corresponding seating 102A (FIGS. 1 and 2).

After a predetermined time, the head 101 is lifted (broken line in FIG. 4) and transferred to the release station R, together with the articles 2 held via aspiration by the relative gripping units 102 (continuous lines in FIG. 4).

The closing of the intercepting organs, with the consequent return of atmospheric pressure inside the conduits 102B, determines the disengagement of the articles 2 from the seatings 102A and the fall of the articles 2 into the conveyor means 104 below and from there into the container 1 (see FIG. 4).

If the device 100 is associated to packing machines with continuous advancement of the container 1, the movement organs 103 must allow the head 101 to perform a follow-up run with the container 1 transiting in the filling station SR, for a length sufficient to allow discharge of the articles 2; obviously, at the same time motors must be provided, associated to the conveyor means 104 and capable of making the conveyor means perform a relative follow-up run synchronized with that of the head 101.

The functioning described above refers to the simplest situation, in which the batch to be inserted into the container 1 consists of a number of articles 2 equal to the number of gripping units 102 provided in the head 101; in this case the container can be completely filled with one single operational cycle of the head 101.

For batches consisting of fewer articles 2 than there are gripping units 102 it is sufficient to exclude the gripping units 102 in excess by intervening on the respective intercepting organs to keep them closed.

For batches formed by more articles 2 than there are gripping units 102, additional operational cycles of the head 101 have to be effected, with the gripping units 102 all or partially active according to the number of articles to be collected to complete the batch.

If the control means detect one or more failed collections of articles 2 by the corresponding gripping units 102 from the tray 105, the management program of the device 100 and of the packing machine intervenes and activates automatic operations to expel the container 1 which has received a number of products 2 not corresponding to the predetermined number from the production line.

In a variant which is not illustrated, the device 100 can exhibit multiple organs for filling more than one container at the same time in each operating cycle.

The foregoing description highlights the advantageous characteristics of the device of the invention, in particular concerning functionality and versatility in use, which remain constant independently of the shape of the articles and which allow picking up of the articles directly from a tray in which the articles are inserted loose, without the complicated separation procedures necessary for counting the articles in prior art devices.

A further advantageous aspect of the device is that the batch is formed directly inside the container, thus reducing the overall amount of handling to which the articles are subjected and thus also reducing the possibility of damage to the articles.

Thanks to the device's operational flexibility, it is possible to adapt any packing machine easily to diverse formats of both articles and containers, while maintaining a high standard of reliability and increasing the range of possible applications of the machine.

A further important advantage, deriving from the conformation of the device, concerns the limited number of components peculiar to each article format, substantially only the gripping units, which can constitute a single assembly and be replaceable in one rapid operation.

Since the device of the invention ensures absolute control over the number of articles inserted into each container, it is certainly suited to use in the pharmaceuticals sector and further, thanks to its simplicity and low cost, can advantageously be used also in other sectors, in place of other systems.

Instead of the tray 105 feeders of any type could be used, in which for example those in which the articles are closely arranged in parallel lines, or are ordered in relative seatings, with the seatings arranged for example in lines.

The above-described device is substantially constituted by a small number of elements of simple conception and limited cost, which elements are moved by organs such as robotic arms which are very well tried and tested and which, though not being inexpensive, have known costs unlikely to undergo very large unexpected rises in price due to the results of experimentation; their price also reflects accurately the level of their performance.

The above is however intended as a non-limiting example of the device; modifications of details thereof, to any one of its illustrated embodiments, for construction and/or functional reasons, will be considered forthwith to enter within the ambit of protection therefore, as defined in the following claims.

The invention claimed is:

1. A device for picking up articles from a supply station and inserting the articles into a container, wherein the device comprises;

at least an operating head, provided with a group of depression-activated gripping units, each of which is shaped in a special format to pick up and retain a corresponding article;

control means, which verify a presence of an article at each of the gripping units;

movement organs which cause the operating head to perform outward and return runs, respectively from a picking up station of the articles to a release station of the articles, situated nearby the container, and vice versa;

conveyor means, provided at the release station, above an opening of the container, and destined to be interposed between the opening and the operating head to guide insertion of the articles into the container;

enabling organs, activated in a phase relation with the movement organs, for activating the gripping units at the supply station in order for a corresponding number of articles to be picked up by means of the gripping units, and for deactivating the gripping units at the release station, thus disengaging the articles from the gripping units and causing the articles to fall into the conveyor means located there below;

wherein at least one tray is located at the picking up station, into which said at least one tray the articles are fed loose, forming a heap of the articles into which the depression-activated gripping units, borne by the operating head, are partially inserted in order to pick up and retain corresponding articles; and wherein the movement organs impress horizontal motions of predetermined amplitude and direction on the operating head, in a phase relation with the insertion of the gripping units into the heap of the articles, in order to facilitate spontaneous engaging of the articles by the gripping units.

2. The device of claim 1, wherein the gripping units each comprise an elongate body, which extends downwards and is traversed longitudinally by an aspiration conduit shaped inferiorly such as to define a seating exhibiting form and dimensions which are complementary to a form and dimension of a corresponding article of the articles.

3. The device of claim 2, wherein the control means are associated to each of the gripping units.

4. The device of claim 2, wherein the movement organs are constituted by at least one robotic arm functioning along Cartesian axes with electronically-controlled movements.

5. The device of claim 2, wherein the movement organs are constituted by at least one robotic arm having electronically-controlled anthropomorphic movements.

6. The device of claim 1, wherein the control means are associated to each of the gripping units.

7. The device of claim 6, wherein the control means are of a type for measuring a depression.

8. The device of claim 1, wherein organs are present in the tray, which organs maintain a predetermined level of the articles, which level is homogeneous throughout the tray.

9. The device of claim 1, wherein the articles are reciprocally closely arranged in parallel rows at the picking up station.

10. The device of claim 1, wherein at the picking up station the articles are arranged in relative seatings.

11. The device of claim 10, wherein the seatings are arranged in rows.

12. The device of claim 1, wherein the movement organs are constituted by at least one robotic arm functioning along Cartesian axes with electronically-controlled movements.

13. The device of claim 1, wherein the movement organs are constituted by at least one robotic arm having electronically-controlled anthropomorphic movements.

14. The device of claim 1, wherein the conveyor means comprise a hopper, the upper inlet section of which has a larger area than an area of the group of gripping units seen in plan view, and has a lower outlet section which is no larger than a section of the opening of the container.

* * * * *